US006352161B1

(12) United States Patent
Huang

(10) Patent No.: US 6,352,161 B1
(45) Date of Patent: Mar. 5, 2002

(54) MULTIPURPOSE RACK

(75) Inventor: James Huang, Taipei (TW)

(73) Assignee: Kenmark Industrial Co., Ltd. (TW)

( * ) Notice: Subject to any disclaimer, the term of this patent is extended or adjusted under 35 U.S.C. 154(b) by 0 days.

(21) Appl. No.: 09/479,987

(22) Filed: Jan. 10, 2000

(51) Int. Cl.[7] ..... A47G 29/00; A47B 81/06

(52) U.S. Cl. ..... 211/40; 211/41.12; 312/9.48

(58) Field of Search ..... 211/40, 41.12; D6/407; 312/9.1, 9.9, 9.21, 9.32, 9.48, 9.52, 9.53, 9.55, 9.64; 206/307, 307.1, 308.1, 387.1; 248/222.11, 222.12, 231.85

(56) References Cited

U.S. PATENT DOCUMENTS 2,321,794 A * 6/1943 Braun
5,080,231 A * 1/1992 Price, Jr. et al. ..... 206/387.1
5,103,986 A * 4/1992 Marlowe ..... 211/41.12
5,183,177 A * 2/1993 Yu ..... 206/387.1
5,231,552 A * 7/1993 Schneider et al. ..... 211/40
5,346,074 A * 9/1994 Overholser ..... 211/40
5,385,398 A * 1/1995 Huys ..... 312/9.47
5,456,368 A * 10/1995 Zehnder ..... 211/40
5,725,105 A * 3/1998 Boland ..... 211/40
5,791,748 A * 8/1998 Marhefka ..... 312/9.48
5,862,922 A * 1/1999 Gallagher ..... 211/41.12
6,019,230 A * 2/2000 Hayashi ..... 211/41.12
6,039,190 A * 3/2000 Clausen ..... 211/40
6,104,445 A * 8/2000 Kim ..... 211/40
6,155,659 A * 12/2000 Manes et al. ..... 312/9.48
6,186,456 B1 * 2/2001 Marsh ..... 248/243
6,203,129 B1 * 3/2001 Kupferschmid ..... 312/9.48
6,244,677 B1 * 6/2001 Millhiser et al. ..... 312/9.48

* cited by examiner

*Primary Examiner*—Daniel P. Stodola
*Assistant Examiner*—Jennifer E. Novosad
(74) *Attorney, Agent, or Firm*—Bacon & Thomas, PLLC

(57) ABSTRACT

A multipurpose rack structure. The structure includes a frame and two vertical plates which are provided on lateral plates of the frame, and inner sides of the two vertical plates are symmetrically provided with horizontal engaging rails that form rail clamps for insertion of compact discs and video tapes, etc. The structure includes movable lugs that are provided in the rail clamps. The movable lugs are provided with an elastic restoration function so that when articles are placed in the rail clamps, the movable lugs are pressed by a pressing force and the articles are held in place by an elastic clamping force. When the articles are taken out of the rail clamps, the movable lugs are released back to their original positions.

3 Claims, 4 Drawing Sheets

MULTIPURPOSE RACK

BACKGROUND OF THE INVENTION

1. Field of the Invention

The present invention is related to a multipurpose rack structure, and especially to such a structure for receiving video tapes, acoustic recording tapes, acoustic and video compact discs (CD's), etc.

2. Description of the Prior Art

Conventionally, acoustic and video carriers including acoustic recording tapes, video tapes, CD's, VCD's, DVD's etc. were stored on shelves or in cabinets or drawers for centralized management when users bought them in a large amount for storage.

Modes of articles storing on shelves, in cabinets or drawers not only take such large spaces that other things could not be stored, but also have the spaces fixed rather than made separable. They do not allow convenient drawing out of the articles when the latter are stacked horizontally; and collapsing or dropping may occur when the articles are drawn out or subjected to an earthquake. If they are disposed vertically, limited amount of layers are available, and wasting of space results.

In view of these, some manufactures developed specific racks for storing acoustic and video carriers. Such a rack mainly has two mutual opposite vertical plates on the lateral plates of a frame, each vertical plate is provided with a lot of rail clamps for inserting therein CD's. The spaces of the rail clamps manufactured are fixed and not able to be partitioned, they can only be used for insertion of individual CD's or recording tapes or video tapes. When a user has not that many acoustic recording tapes, video tapes, CD's, VCD's, DVD's etc., it is bothersome and space wasting if he wants to do centralized management, because a plurality of racks are supposed to serve for this.

SUMMARY OF THE INVENTION

In order to effectively solve the above stated disadvantage resided in conventional acoustic and video carriers or racks, the inventor of the present invention provides a multipurpose rack structure after continual studying and designing for years based on his practical experience, and multiple tests and examinations, the multipurpose rack structure can eliminate the defects resided in the conventional racks, and convenience in use can be increased.

The rack of the present invention is comprised mainly of a frame and two vertical plates, wherein, the two vertical plates are opposite to each other, the inner sides of the two vertical plates are provided with a lot of horizontal engaging rails, both lateral edges of a CD can be placed between two neighboring rails on both the two vertical plates. The rails form the rail clamps for CD's or video tapes etc., and movable lugs are provided in the rail clamps. The movable lugs are provided with elastic restoration function. When the rail clamps are filled therein with articles, the movable lugs are pressed and hold the articles by their elastic clamping force; and when the articles are taken out, the movable lugs are released to restore their protruding positions.

The main object of the present invention is to provide a multipurpose rack structure, it allows video tapes etc. to insert into the rail clamps thereof, the movable lugs are pressed and hold the articles by their elastic clamping force, thus the video tapes etc. can be positioned by them.

Another object of the present invention is to provide a multipurpose rack structure, wherein, a partitioning plate is provided on the rear side of the frame, the partitioning plate is provided with a plurality of positioning holes in corresponding to a plurality of positioning holes provided on the inner sides of the two lateral plates of the frame. A fixing rack can be mounted between every two corresponding positioning holes. Each fixing rack is provided with a plurality of holding spaces of identical width for insertion of acoustic recording tapes, acoustic or video CD's etc.

Another object of the present invention is to provide a multipurpose rack structure, wherein, a plurality of rod members are provided on the frame, every two rod members form therebetween a receiving space for storing housings of acoustic recording tapes, video tapes or acoustic or video CD's etc.

Another object of the present invention is to provide a multipurpose rack structure, wherein, one or more than one shelf plates are provided between the two vertical plates, each shelf plate is provided on both lateral sides thereof with a slide way for inserting therein an engaging rail. In this way, the frame can be separated into several spaces. The present invention will be apparent in its objects and detailed structure after reading the detailed description of the preferred embodiment thereof in reference to the accompanying drawings.

DETAILED DESCRIPTION OF THE PREFERRED EMBODIMENT

Figure 1:
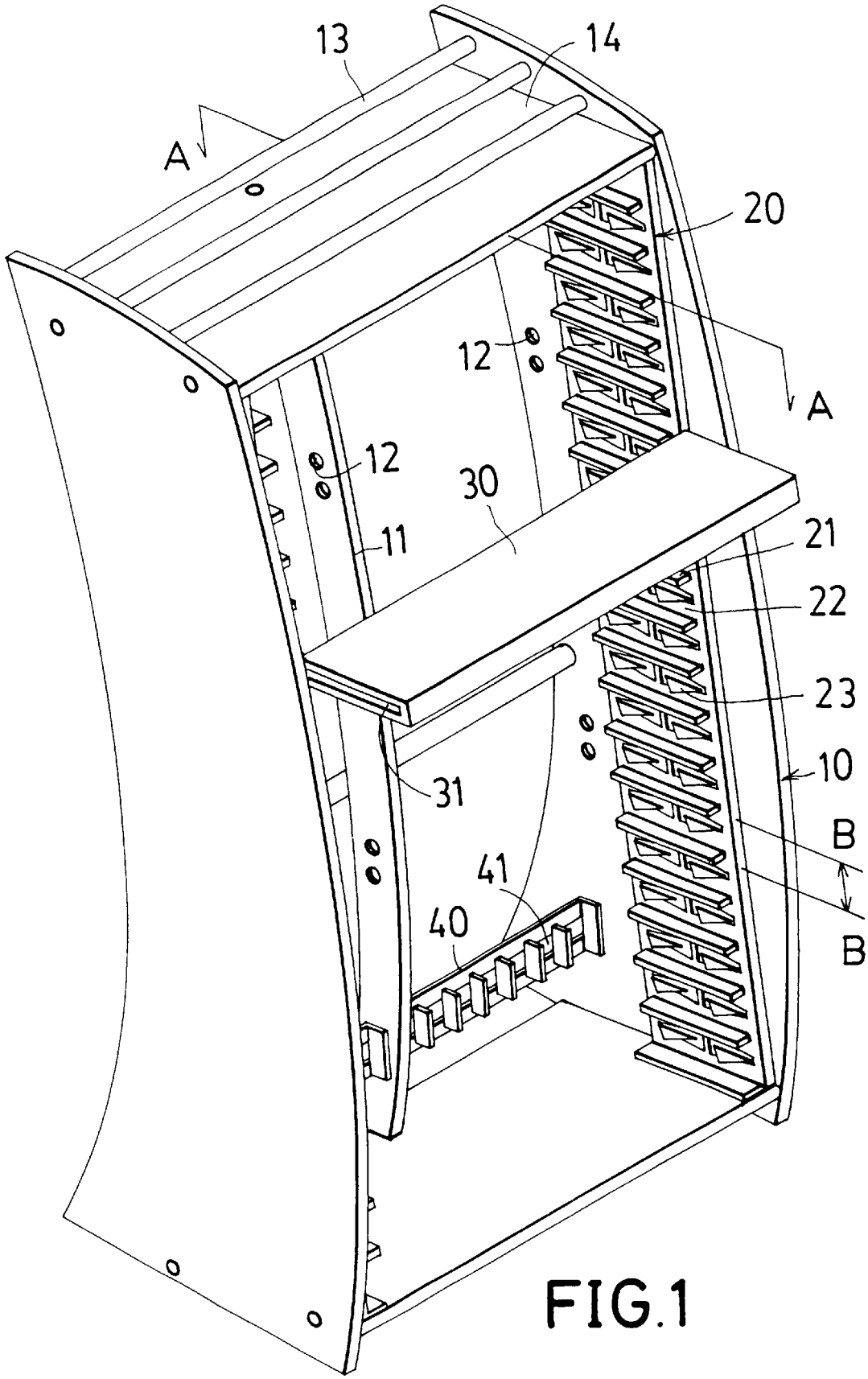
FIG. 1 is a perspective view of the present invention.
Figure 2:
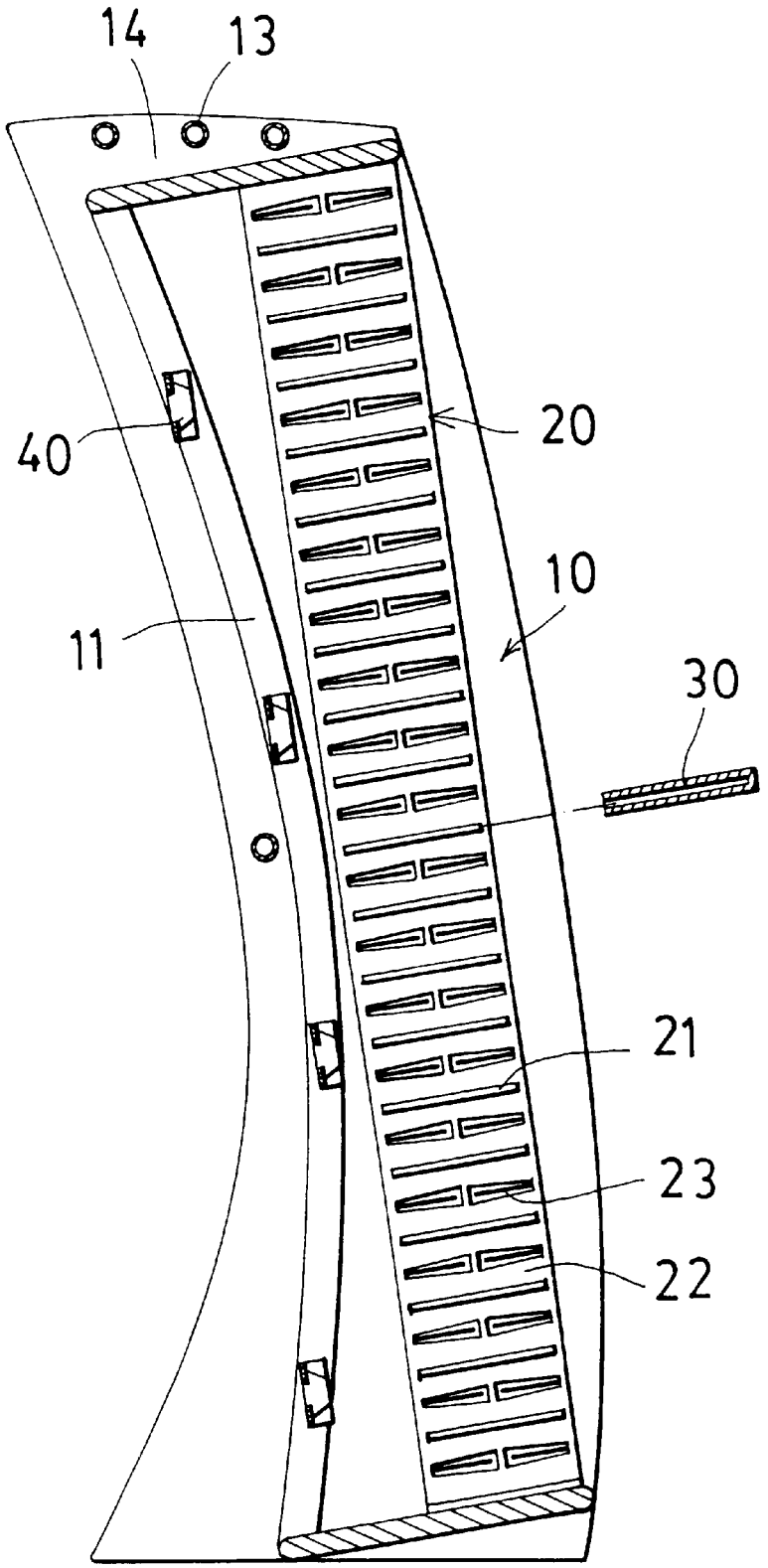
FIG. 2 is a sectional view taken from A—A line of FIG. 1.

Referring to FIG. 1 and 2, the multipurpose rack structure of the present invention is comprised mainly of a frame 10, two vertical plates 20, a plurality of shelf plates 30 and a plurality of fixing racks 40.

Wherein, the frame 10 is provided on the rear thereof with a partitioning plate 11. The partitioning plate 11 and the inner sides of the two lateral plates of the frame 10 are provided with a plurality of positioning holes 12. And a plurality of rod members 13 are provided on the frame 10, every two rod members 13 form therebetween a receiving space 14.

The two vertical plates 20 are provided on the lateral sides of the frame 10, the inner sides of the vertical plates 20 are symmetrically provided with a lot of horizontal engaging or engagement rails 21. The engaging rails 21 form rail clamps 22, and movable lugs 23 are provided in the rail clamps 22.

The shelf plates 30 are provided on both lateral sides thereof each with a slide way 31 for inserting therein an engaging rail 21. In this way, the frame 10 can be separated into several spaces.

The fixing racks 40 are mounted in positioning holes provided on partitioning plate 11 and the inner sides of the two lateral side plates of the frame 10, and are provided with a plurality of holding spaces 41 of identical width.

Figure 3:
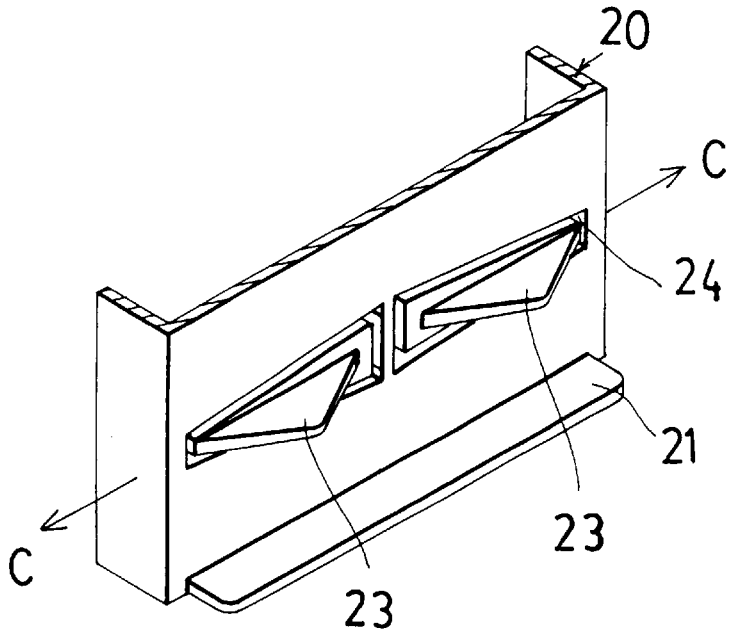
FIG. 3 is a sectional view taken from B—B line of FIG. 1.
Figure 4:
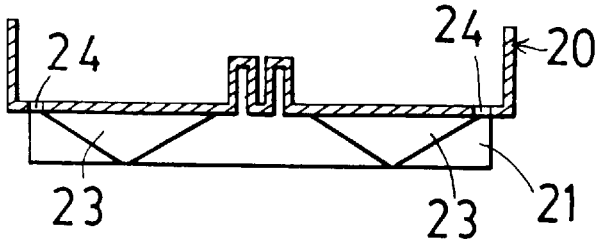
FIG. 4 is a sectional view taken from C—C line of FIG. 3.
Figure 5:
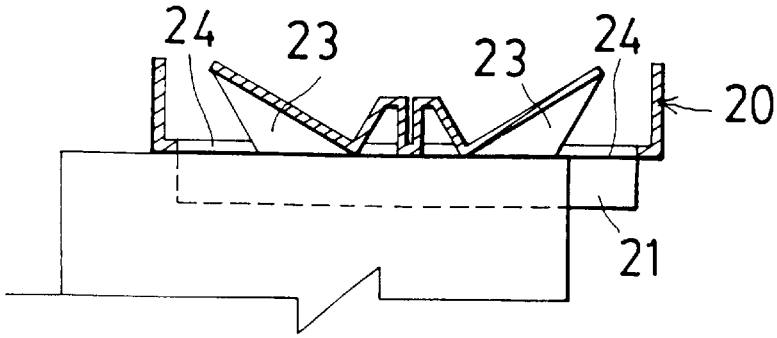
FIG. 5 is a schematic sectional view showing movement of the movable lugs of the present invention.

The movable lugs 23 provided in the rail clamps 22 on the vertical plates 20 are each integrally formed on a lateral edge of one of the slots 24 provided on the vertical plates 20 (as shown in FIGS. 3, 4) and are provided with elastic restoration function. When the movable lugs 23 are pressed by external force, they retract into the slots 24 (as shown in Fig. 5), and are released to restore their protruding positions when the force is removed.

Figure 6:
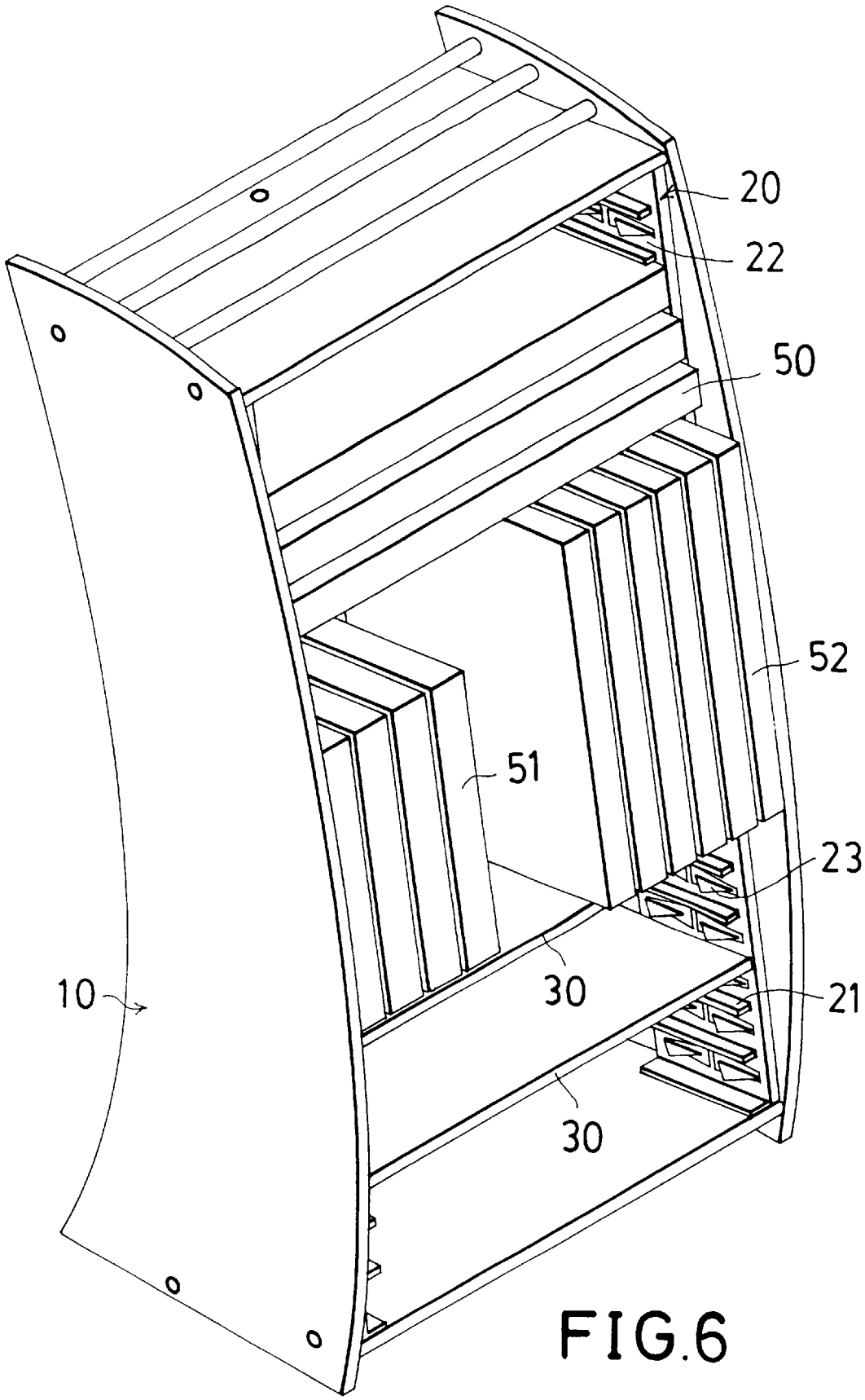
FIG. 6 is a schematic sectional view showing the present invention in use.

Referring to FIG. 6 the frame 10 of the present invention is separated into several spaces with desired height for insertion of video tapes 50, acoustic recording tapes 51 and acoustic or video compact discs (CD's) 52 etc. in favor of centralized management of these articles.

When in practice of the multipurpose rack, the video tapes 50 can be horizontally or vertically placed into the spaces defined by the shelf plates 30. If they are horizontally placed, the video tapes 50 are inserted into pairs of rail clamps 22 on both the vertical plates 20, and the movable lugs 23 are pressed and elastically re tract into the slots 24 and hold the video tapes 50 by their elastic clamping force, thus the video tapes 50 can be positioned in the rail clamps 22. If they are vertically placed, the video tapes 50 are abutted against the rear plates of the fixing racks 40 and are prevented from dropping.

And the holding spaces 41 on the fixing racks 40 are provided mainly for inserting therein acoustic recording tapes 51 and acoustic or video CD's 52 etc., the latter can also be optionally inserted in the rail clamps 22 for positioning.

The shelf plates 30 and fixing racks 40 mounted on the frame 10 can be increased or reduced depending on requirement of a user to adjust allocation of spaces. In this way, applicability of the multipurpose rack can be improved, and spaces for storing can be effectively used.

Moreover, the frame 10 of the present invention is provided with a plurality of rod members 13 on the frame 10, and every two rod members 13 form therebetween a receiving space 14 of different size in order to receive housings of the video tapes 50, acoustic recording tapes 51 and acoustic or video CD's 52 etc. in favor of centralized management of these housings.

One thing worth mentioning, the top and bottom plates of the frame 10 of the present invention are arranged that the front edges of them are higher than the rear edges thereof respectively; hence when the vertical plates 20 are fixed on the frame 10, they are also tilted in pursuance of the inclination of top and bottom plates of the frame 10. Therefore, when the video tapes 50, acoustic recording tapes 51 and acoustic or video CD's 52 etc. are placed on the multipurpose rack, the tilted vertical plates 20 can prevent dropping in case there is an earthquake.

The multipurpose rack structure of the present invention is applicable to various types of video tapes, acoustic recording tapes and acoustic or video CD's etc., and it is extremely convenient to use. Therefore, the present invention is industrially valuable, and is novel and provided with improvement.

What is claimed is:

1. A multipurpose rack structure comprising:

a frame comprising at least two lateral plates;

left and right vertical plates, the vertical plates each having inner and outer sides, each of the vertical plates immovably secured to one of the lateral plates, with the inner sides of the vertical plates facing each other and spaced apart;

the inner sides of the vertical plates comprising a plurality of horizontal engagement rails horizontally extending out of the inner sides of the vertical plates, the engagement rails are immovably attached to the vertical plates;

rail clamps each positioned between adjacent ones of the horizontal engagement rails, each of the rail clamps comprising a movable lug that extends outwardly in a horizontal direction, the movable lugs are elastically bendable in a direction toward the outer sides of the vertical plates when an article is frictionally inserted between one of the rail clamps of the left vertical plate and one of the rail clamps of the right vertical plate, such that an article is clampable between the vertical plates and when such article is removed, the movable lugs that were bent temporarily are restored to their original positions; and said frame is provided on a rear thereof with a vertical partitioning plate, said partitioning plate and the inner sides of the two lateral plates of said frame are provided with a plurality of positioning holes, fixing racks are mounted in said positioning holes and are provided with a plurality of holding spaces of identical width.

2. A multipurpose rack structure comprising:

a frame comprising at least two lateral plates;

left and right vertical plates, the vertical plates each having inner and outer sides, each of the vertical plates immovably secured to one of the lateral plates, with the inner sides of the vertical plates facing each other and spaced apart;

the inner sides of the vertical plates comprising a plurality of horizontal engagement rails horizontally extending out of the inner sides of the vertical plates, the engagement rails are immovably attached to the vertical plates;

rail clamps each positioned between adjacent ones of the horizontal engagement rails, each of the rail clamps comprising a movable lug that extends outwardly in a horizontal direction, the movable lugs are elastically bendable in a direction toward the outer sides of the vertical plates when an article is frictionally inserted between one of the rail clamps of the left vertical plate and one of the rail clamps of the right vertical plate, such that an article is clampable between the vertical plates and when such article is removed, the movable lugs that were bent temporarily are restored to their original positions; and said frame is provided with a plurality of rod members, every two of said rod members form therebetween a receiving space for storing housings of an article selected from the group consisting of video tape and acoustic recording tape.

3. A multipurpose rack structure comprising:

a frame comprising at least two lateral plates;

left and right vertical plates, the vertical plates each having inner and outer sides, each of the vertical plates immovably secured to one of the lateral plates, with the inner sides of the vertical plates facing each other and spaced apart;

the inner sides of the vertical plates comprising a plurality of horizontal engagement rails horizontally extending out of the inner sides of the vertical plates, the engagement rails are immovably attached to the vertical plates;

rail clamps each positioned between adjacent ones of the horizontal engagement rails, each of the rail clamps comprising a movable lug that extends outwardly in a horizontal direction, the movable lugs are elastically bendable in a direction toward the outer sides of the vertical plates when an article is frictionally inserted between one of the rail clamps of the left vertical plate and one of the rail clamps of the right vertical plate, such that an article is clampable between the vertical plates and when such article is removed, the movable lugs that were bent temporarily are restored to their original positions; and one or more than one horizontal shelf plates are provided on said vertical plates and are provided each with a slide way for inserting therein one of the engagement rails, such that said frame is separated into several spaces.

* * * * *